US007789626B1

(12) United States Patent
Liang

(10) Patent No.: US 7,789,626 B1
(45) Date of Patent: Sep. 7, 2010

(54) TURBINE BLADE WITH SHOWERHEAD FILM COOLING HOLES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 691 days.

(21) Appl. No.: 11/809,327

(22) Filed: May 31, 2007

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS

| | | | | |
|---|---|---|---|---|
| 5,486,093 | A * | 1/1996 | Auxier et al. | 416/97 R |
| 6,164,912 | A | 12/2000 | Tabbita et al. | |
| 7,114,923 | B2 | 10/2006 | Liang | |
| 2002/0127104 | A1 * | 9/2002 | Beeck et al. | 416/97 R |
| 2005/0281675 | A1 * | 12/2005 | Liang | 416/97 R |
| 2007/0044936 | A1 * | 3/2007 | Memmen | 164/45 |
| 2007/0116566 | A1 * | 5/2007 | Cunha et al. | 416/90 R |

OTHER PUBLICATIONS http://www.merriam-webster.com/dictionary/helical. Accessed Mar. 12, 2010.*
http://www.merriam-webster.com/dictionary/helix. Accessed Mar. 12, 2010.*
http://www.merriam-webster.com/dictionary/spiral. Accessed Mar. 12, 2010.*

* cited by examiner

*Primary Examiner*—Richard Edgar
(74) *Attorney, Agent, or Firm*—John Ryznic

(57) ABSTRACT

A turbine blade used in a gas turbine engine, the blade having a showerhead film cooling hole arrangement along the leading edge of the blade, the showerhead arrangement including three rows of film cooling holes with a middle row being aligned with the stagnation point, a second row on the pressure side of the stagnation point, and the third row on the suction side of the stagnation point. The film cooling holes can be oriented at any angle within each row, and the cooling holes spiral within the airfoil wall to promote heat transfer to the cooling air flow. In large turbine airfoils, very fine cooling passages can be formed in the airfoil wall using the small diameter ceramic core ties used in the present invention.

6 Claims, 3 Drawing Sheets

TURBINE BLADE WITH SHOWERHEAD FILM COOLING HOLES

BACKGROUND OF THE INVENTION

1. Field of the Invention

The present invention relates generally to air cooled turbine airfoils, and more specifically to the cooling of a turbine airfoil leading edge.

2. Description of the Related Art Including Information Disclosed Under 37 CFR 1.97 and 1.98

In a gas turbine engine, a turbine section includes a plurality of stages of stator vanes and rotor blades to convert chemical energy from a hot gas flow into mechanical energy by driving the rotor shaft. The engine efficiency can be increased by passing a higher gas flow temperature through the turbine section. The maximum temperature passed into the turbine is determined by the first stage stator vanes and rotor blades.

These turbine airfoils (stator vanes and rotor blades) can be designed to withstand extreme temperatures by using high temperature resistant super-alloys. Also, higher temperatures can be used by providing internal convection cooling and external film cooling for the airfoils. Complex internal cooling circuits have been proposed to maximize the airfoil internal cooling while using a minimum amount of pressurized cooling air to also increase the engine efficiency.

Besides allowing for a higher external temperature, cooling of the airfoils reduces hot spots that occur around the airfoil surface and increase the airfoil oxidation and erosion that would result in shorter part life. This is especially critical in an industrial gas turbine engine where operation hot times between engine start-up and shut-down is from 24,000 to 48,000 hours. Unscheduled engine shut-down due to a damaged part such as a turbine airfoil greatly increases the cost of operating the engine.

In a gas turbine engine, especially in an industrial gas turbine engine, the first stage stator vanes and rotor blades are exposed to the highest gas flow temperatures in the turbine section. The leading edge region of these airfoils is exposed directly to the hot gas flow. One prior art showerhead film cooling arrangement is disclosed in U.S. Pat. No. 7,114,923 B2 issued to Liang on Oct. 3, 2006 and entitled COOLING SYSTEM FOR A SHOWERHEAD OF A TURBINE BLADE, where the airfoil leading edge is cooled by a showerhead arrangement of film cooling holes that include three rows extending along the airfoil in the spanwise direction. See FIGS. 1 and 2. The middle film row is positioned at the airfoil stagnation point where the highest heat load is located. Film cooling holes for each film row are at inline pattern and incline at from 20 degrees to 30 degrees relative to the blade leading edge radial surface.

Another prior art showerhead arrangement is disclosed in U.S. Pat. No. 6,164,912 issued to Tabbita et al on Dec. 26, 2000 and entitled HOLLOW AIRFOIL FOR A GAS TURBINE ENGINE in which the airfoil leading edge include two rows of film cooling holes each located on opposite sides of a stagnation point, and where each row of cooling holes curves around the airfoil wall in the curvature of the airfoil wall. Each film cooling hole discharges the film cooling air upward and toward the stagnation point of the leading edge.

Fundamental shortfalls associated with the FIG. 1 prior art showerhead arrangement include: the heat load onto the blade leading edge region is parallel to the film cooling hole array which reduces the cooling effectiveness; a portion of the film cooling holes within each film row is positioned behind each other (see FIG. 3) that reduces the effective frontal convective area and conduction distance for the oncoming heat load; and, a realistic minimum film hole spacing to diameter ratio is approximately at 3.0. Below this 3.0 level "zipper effect" cracking may occur for the film row. This translates to a maximum achievable film coverage for that particular film row of around 33% or 0.33 film effectiveness for each showerhead film row.

Despite the variety of leading edge region cooling configurations described in the prior art, further improvement is always desirable in order to allow the use of higher operating temperatures, less exotic materials, and reduced cooling air flow rates through the airfoils, as well as to minimize manufacturing costs.

An object of the present invention is to provide for a turbine airfoil with an improved showerhead film cooling hole geometry that can be used in the blade cooling design, especially for a high temperature blade application with a high leading edge film effectiveness requirement.

Another object of the present invention is to provide for a turbine airfoil with a showerhead film cooling geometry that eliminates the film over-lapping problem of the above cited prior art showerhead arrangements and therefore yield a uniform film layer for the airfoil leading edge region.

BRIEF SUMMARY OF THE INVENTION

A turbine blade used in a gas turbine engine, the blade having a showerhead film cooling hole arrangement along the leading edge of the blade, the showerhead arrangement including three rows of film cooling holes with a middle row being aligned with the stagnation point, a second row on the pressure side of the stagnation point, and the third row on the suction side of the stagnation point. The film cooling holes can be oriented at any angle within each row, and the cooling holes spiral within the airfoil wall to promote heat transfer to the cooling air flow. In large turbine airfoils, very fine cooling passages can be formed in the airfoil wall using the small diameter ceramic core ties used in the present invention.

DETAILED DESCRIPTION OF THE INVENTION

Figure 1:
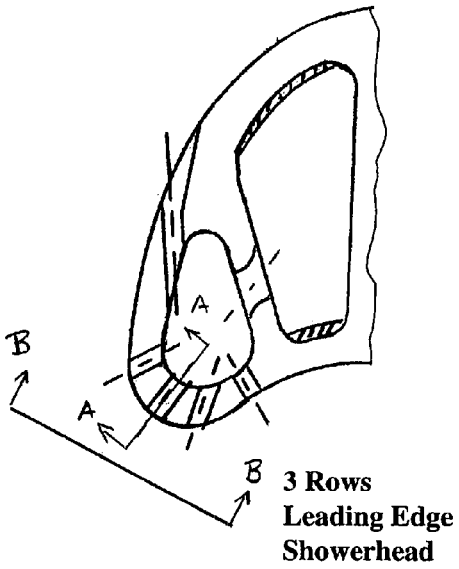
Fig. 1 Prior Art
FIG. 1 shows a cross section view of a leading edge showerhead design for a prior art turbine airfoil.
Figure 2:
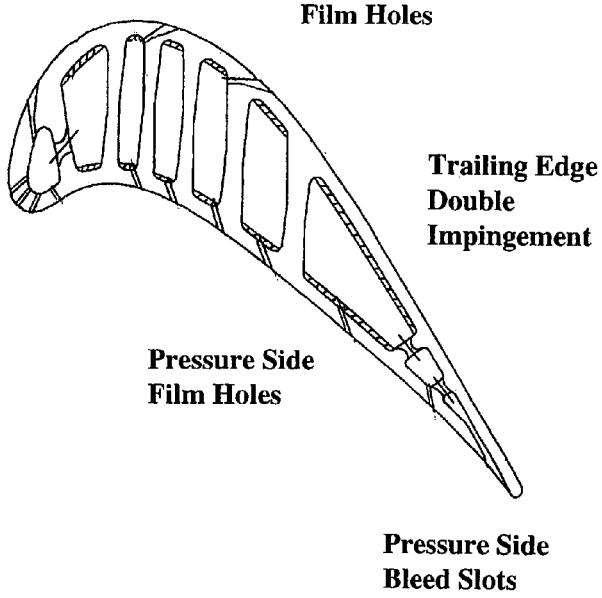
Fig. 2 Prior Art
FIG. 2 shows a cross section view of the airfoil of the prior art FIG. 1 showerhead design.
Figures 3, 4:
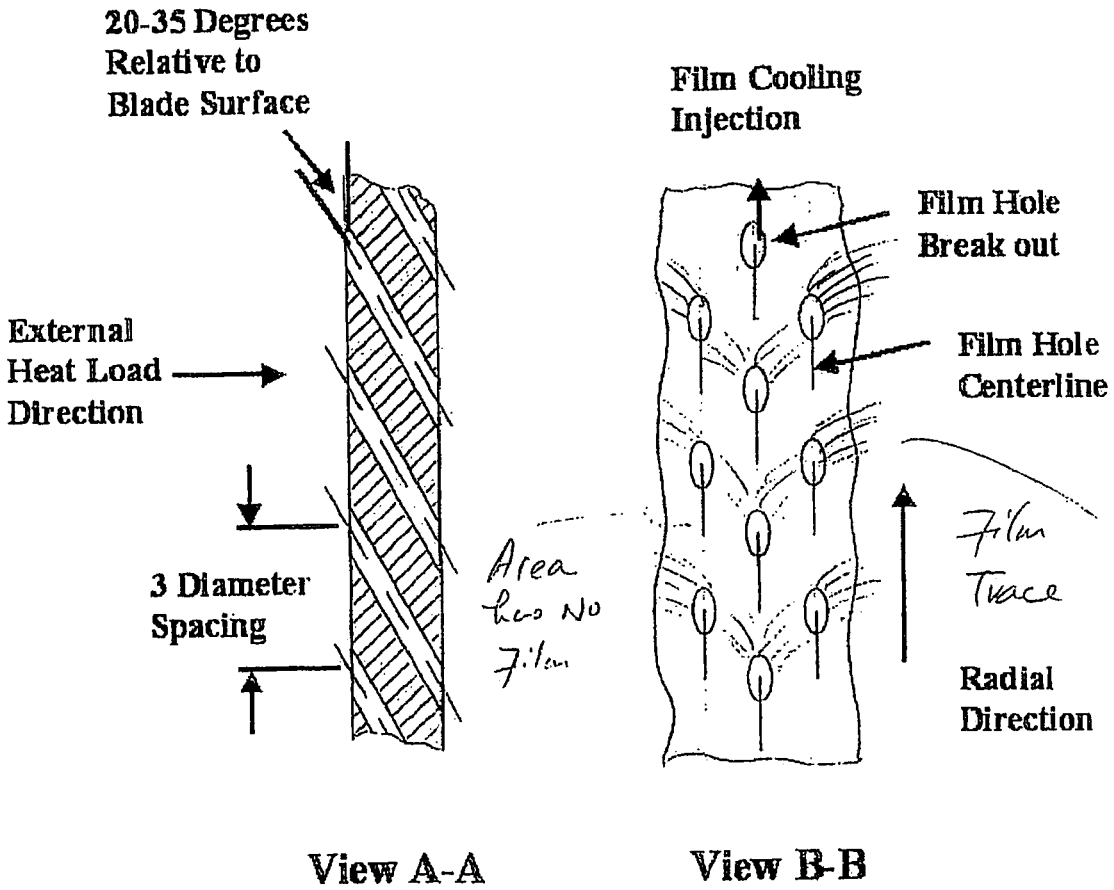
Fig. 3 prior art
Fig. 4 prior art
FIG. 3 shows a cross section view of the film cooling hole through the line shown in FIG. 1.
FIG. 4 shows a front view of the showerhead arrangement of the prior art through the line shown in FIG. 1.
Figure 5:
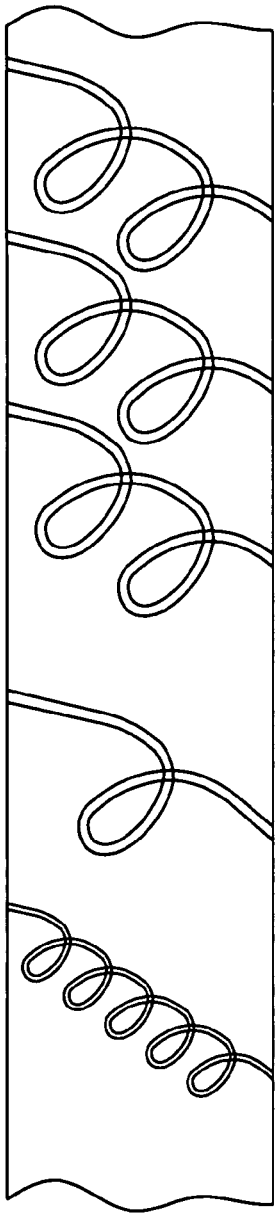
FIG. 5 shows a cross section side view of several spiral shaped film cooling holes of the present invention.
Figure 6:
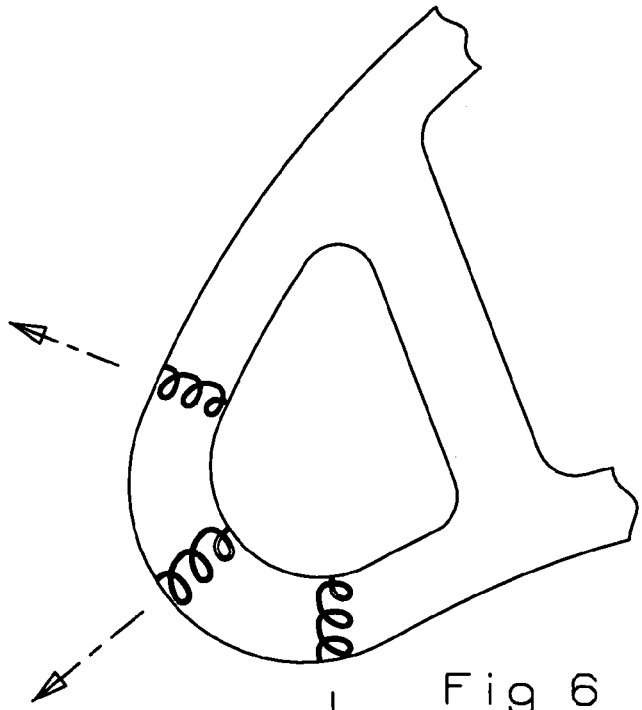
FIG. 6 shows a cross section top view of a leading edge with spiral shaped film cooling holes of the present invention.
Figure 7:
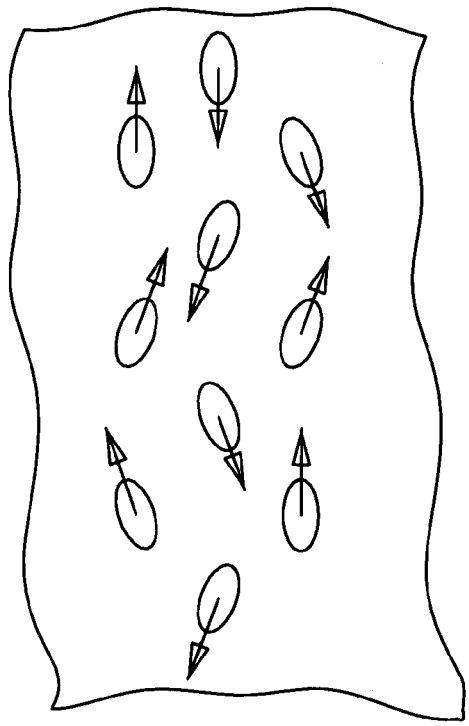
FIG. 7 shows a front view of an airfoil leading edge with the spiral film cooling holes of the present invention opening onto the airfoil surface.

The present invention is a showerhead film cooling arrangement for a turbine airfoil such as a rotor blade used in a gas turbine engine. The showerhead arrangement of the present invention could be used for a stator vane or a rotor blade to provide film cooling for the leading edge region of the airfoil that is exposed to a hot gas flow. FIGS. 5 through 7 show the spiral shaped showerhead film cooling holes of the present invention.

FIG. 5 shows a variety of spiral shaped film cooling holes that can be used in the showerhead arrangement of the present invention. The spiral film cooling hole passes from the leading edge cooling cavity in the airfoil and opens onto the external surface of the airfoil on the leading edge region. FIG. 5 shows that the spiral shaped film cooling hole can have from one spiral to four or more spirals, and slope upward and toward the blade tip in the direction of cooling air flow as seen in this figure. The left side of FIG. 5 represents the external surface of the leading edge. In the example with two spirals in the film cooling hole, the two spirals can be located substantially in the front half of the airfoil cross section or substantially in the rear or aft half of the airfoil cross section as indicated in FIG. 5. In the showerhead arrangement of the present invention, the three rows of spiral film cooling holes will all have the same spiral shaped pattern throughout the airfoil. For example, all three rows of the showerhead film cooling holes may have two spirals located in the forward half of the airfoil wall. However, in other embodiment the film cooling holes can have different spiral arrangements. The present invention is not limited to all three rows having the same spiral shaped arrangement.

A cross section view of the leading edge region of the airfoil with the showerhead arrangement is shown in FIG. 6. The three rows of spiral shaped film cooling holes are shown with the middle row positioned at the stagnation point, a second row located on the pressure side from the first row, and the third row located on the suction side from the first or stagnation row. All three rows of spiral film cooling holes are connected to the leading edge cooling supply cavity. FIG. 7 shows a front view of the showerhead arrangement of the present invention in which the three rows of film cooling holes have opening angles that vary within each row. Within each row, the spiral film cooling hole can discharge the cooling air upwards toward the blade tip, downwards away from the blade tip, away from the stagnation line, toward the stagnation line, and another combination of these direction so that the cooling air discharge direction varies within the row.

The spiral film cooling holes of the present invention can have trip strips included within the holes to promote the heat transfer of heat from the metal to the cooling air flow. The spiral film cooling holes of the present invention can be cast into the airfoil leading edge wall according to the well known investment casting methods known in the prior art.

The ejection direction for each film row can be different from hole to hole and thus no longer inline within the film rows for the leading edge showerhead cooling arrangement. This eliminates the film over-lapping problem of the cited prior art showerhead and yields a uniform film layer for the blade leading edge region. Also, the showerhead arrangement of the present invention can be incorporated into the airfoil leading edge inner and outer surfaces in a staggered array formation.

Several design features and advantages of the present invention over the cited prior art showerhead film hole designs are described below. The micro spiral film cooling holes of the present invention increase the frontal convection area for the oncoming heat load. In addition, the micro spiral showerhead geometry reduces conduction length and increases film hole convection length that yields a more effective showerhead cooling design. Because of the small diameter size of the micro spiral ceramic cores, the film cooling holes used in larger turbine airfoils, such as in an industrial gas turbine engine, can be made from the casting process describe in the present invention instead of with the well known laser drilling, machine drilling or EDM process. These well known processes are much more expensive than casting the small film cooling holes using the well known investment casting process.

The micro spiral showerhead geometry improves the leading edge film hole packaging which increases the film coverage and thus the leading edge film effectiveness. This results in a lower film temperature and lower metal temperature. The showerhead row can be a staggered array formation at both inner and outer surfaces.

Since film holes in each film row are not at the same angular position to each other, the possibility of "zipper cracking" can be avoided even for a high density showerhead cooling design with additional film holes. Thus, a film coverage or film effectiveness as high as 90% can be achieved.

The micro spiral film cooling holes induce multiple injection directions within each film row. Elimination of film hole interference at the film hole entrance region can be eliminated and increase the design flexibility for a maximum film coverage.

The continuous change in the cooling air angular momentum within the micro spiral showerhead film cooling hole as the cooling air flows through the hole will increase the cooling flow internal heat transfer coefficient and provide a high cooling performance.

I claim the flowing:

1. A turbine airfoil for use in a gas turbine engine, the airfoil comprising:

a leading edge region and a trailing edge region;

a pressure side wall and a suction side wall both extending between the leading and the trailing edge regions;

a cooling supply channel extending along the leading edge region of the airfoil;

a showerhead of film cooling holes to cool the leading edge region of the airfoil, the showerhead film cooling holes having a spiral shape that forms at least one spiral from the inlet to the outlet;

and the spiral shaped film cooling holes of the showerhead are slanted with respect to a radial outward direction of the turbine airfoil.

2. The turbine airfoil of claim 1, and further comprising:

the showerhead film cooling holes comprises at least three rows of film cooling holes with one of the rows having a plurality of opening located substantially along the stagnation line of the leading edge.

3. The turbine airfoil of claim 1, and further comprising:

the showerhead film cooling holes comprises at least three rows of film cooling holes and in which each row includes at least two film cooling hole openings that direct cooling air into different directions.

4. The turbine airfoil of claim 3, and further comprising:

each of the at least three rows of film cooling holes includes openings in which adjacent hole openings discharge cooling air in a different direction.

5. The turbine airfoil of claim 1, and further comprising:

the spiral shaped film cooling holes have substantially a constant diameter.

6. The turbine airfoil of claim 1, and further comprising:

the spiral shaped film cooling holes form at least five spirals from the inlet to the outlet of the film cooling hole.

* * * * *